US006082231A

United States Patent [19]

Tsai

[11] Patent Number: 6,082,231

[45] Date of Patent: Jul. 4, 2000

[54] PLIERS

[76] Inventor: Kun-Tien Tsai, 5f-23, 70, Fu-Shing Road, Taoyuan, Taiwan

[21] Appl. No.: 09/136,727

[22] Filed: Aug. 19, 1998

[51] Int. Cl.[7] ..... B25B 7/12

[52] U.S. Cl. ..... 81/364; 81/367

[58] Field of Search ..... 81/318, 319, 324, 81/325, 328, 331, 332, 337, 338, 364

[56] References Cited

U.S. PATENT DOCUMENTS

| | | | |
|---|---|---|---|
| 2,750,826 | 6/1956 | Lisbon | 81/337 |
| 3,600,986 | 8/1971 | Baldwin | 81/319 |
| 4,062,218 | 12/1977 | Wiener | 81/319 |

FOREIGN PATENT DOCUMENTS

| | | | |
|---|---|---|---|
| 144 | 1/1910 | United Kingdom | 81/364 |

*Primary Examiner*—David A. Scherbel
*Assistant Examiner*—Daniel G. Shanley
*Attorney, Agent, or Firm*—Dougherty & Troxell

[57] ABSTRACT

A pair of pliers includes a body, a movable handle, a movable jaw, a push block, and a pull element. The movable handle and the movable jaw are both connected pivotally to the body so that they can displace about an angle. When the movable handle turns in the direction of the body, it can bring the push block to displace therewith so that a U-shaped end push portion of the push block press against a curved rack portion at the bottom face of the lower portion of the movable jaw, causing the curved jaw teeth of the movable jaw to close in the direction of a fixed jaw. And when the movable handle and the end push portion disengage from the front acting teeth of the curved rack portion, they can press against the rear acting teeth of the curved rack portion to clamp pipes of a larger contact surface. When the movable handle is turned outwardly away from the fixed handle, the pull element is utilized to cause the movable jaw to pull and turn quickly to a desired angle. For small-diameter pipes, pressure can be applied directly on the upper portion of the movable jaw to turn the pipe in a single operation.

8 Claims, 10 Drawing Sheets

PLIERS

BACKGROUND OF THE INVENTION (a) Field of the Invention

The present invention relates to a hand tool used to clamp and turn pipe fittings, unions, pipe joints, etc., to cause them to inter-engage screwably, and more particularly to a pair of pliers that has a enhanced clamping effects, and that is convenient to operate.

(b) Description of the Prior Art

A conventional pair of pliers is generally F-shaped and includes mainly a handle, a turning knob, and a fixed jaw and a movable jaw capable of relative parallel displacement. Since the fixed jaw and the movable jaw use their parallel planar faces to contact pipes, the acting area is small and slippage may occur when clamping pipes. Besides, in operation, if the turning knob is directly turned to cause the fixed jaw and the movable jaw to clamp the pipe, it will be time-consuming to adjust the turning knob, so that the clamping effect is not satisfactory. If the clearance between the fixed jaw and the movable jaw is set before clamping, the clearance may not be properly set and will need adjustments, which is very inconvenient. Furthermore, in order to adapt to pipes of different diameters, the turning knob has to be turned several rounds to cause the fixed jaw and the movable jaw to open or close in order to arrive at a desired clearance, which is time-consuming and troublesome.

SUMMARY OF THE INVENTION

A primary object of the present invention is to provide a pair of pliers in which a push block is provided to press against a curved rack portion on a bottom face of a lower portion of a movable jaw so that, by working a movable handle, the movable jaw can displace about a set small angle to gradually close upon a fixed jaw. Besides, by pressing a movable handle, the push block can be caused to press against the curved rack portion of the movable jaw to clamp a pipe so that a pressure can be exerted on a fixed handle to turn the pipe.

Another object of the present invention is to provide a pair of pliers in which the movable jaw can be opened quickly so that when the movable jaw is in a slightly closed position, the movable handle can be pulled outwardly to open the movable jaw to a desired angle in a single operational step, allowing the pliers clamp and turn the pipe quickly.

A further object of the present invention is to provide a pair of pliers, in which the movable jaw can be closed quickly in a single operational step to clamp and turn a small-diameter pipe, without the need to close the movable jaw gradually, which is time-consuming and troublesome in operation.

Still another object of the present invention is to provide a pair of pliers that has opposed and recessed curved jaw teeth portions to increase the contact acting area with pipes so as to enhance the clamping effect. Besides, a compression spring is provided at the joint or pivot of the movable to ensure a certain tightness during movement of the movable jaw so that the movable jaw cannot displace freely or slip from position.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
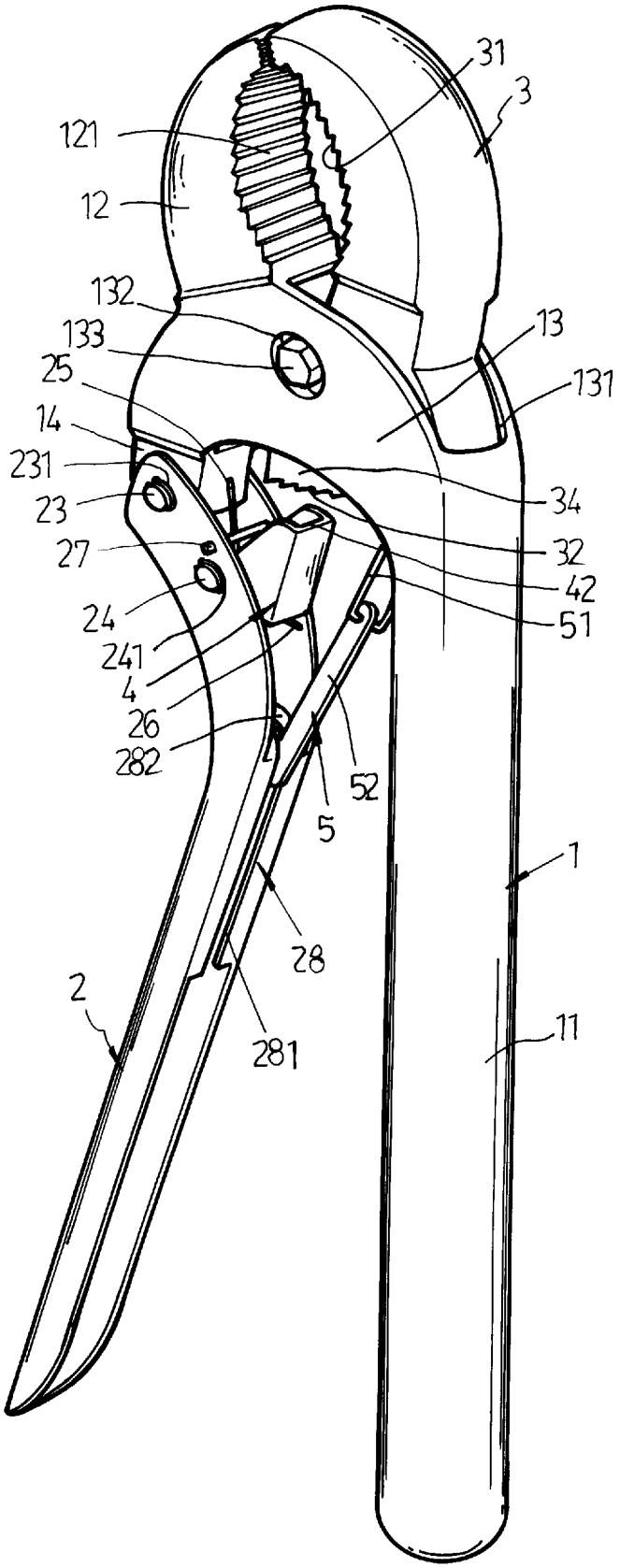
FIG. 1 is a perspective view of an embodiment of the pliers of the present invention.
Figure 2:
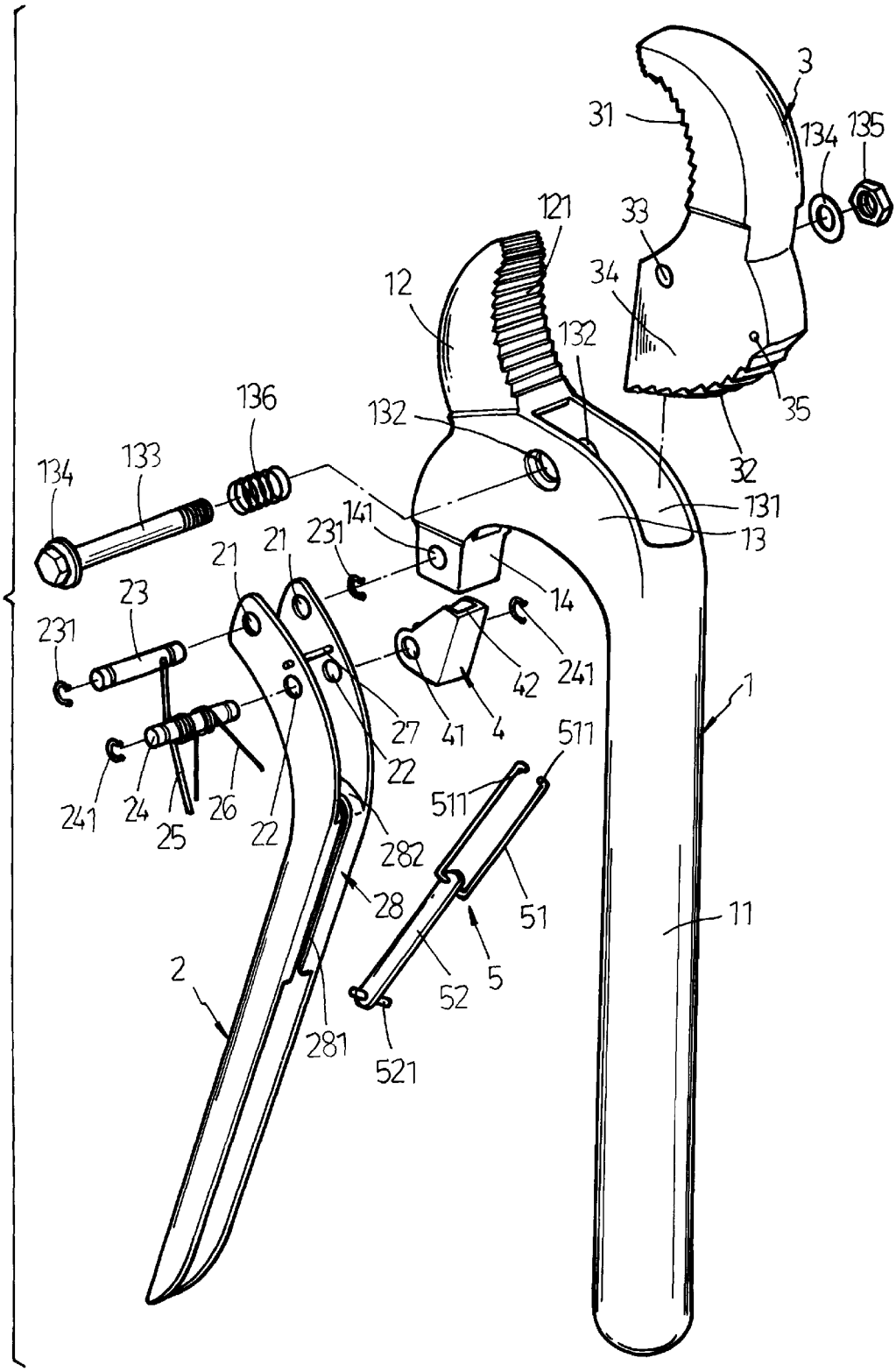
FIG. 2 is a perspective exploded view of the embodiment of the pliers of the present invention.
Figure 3:
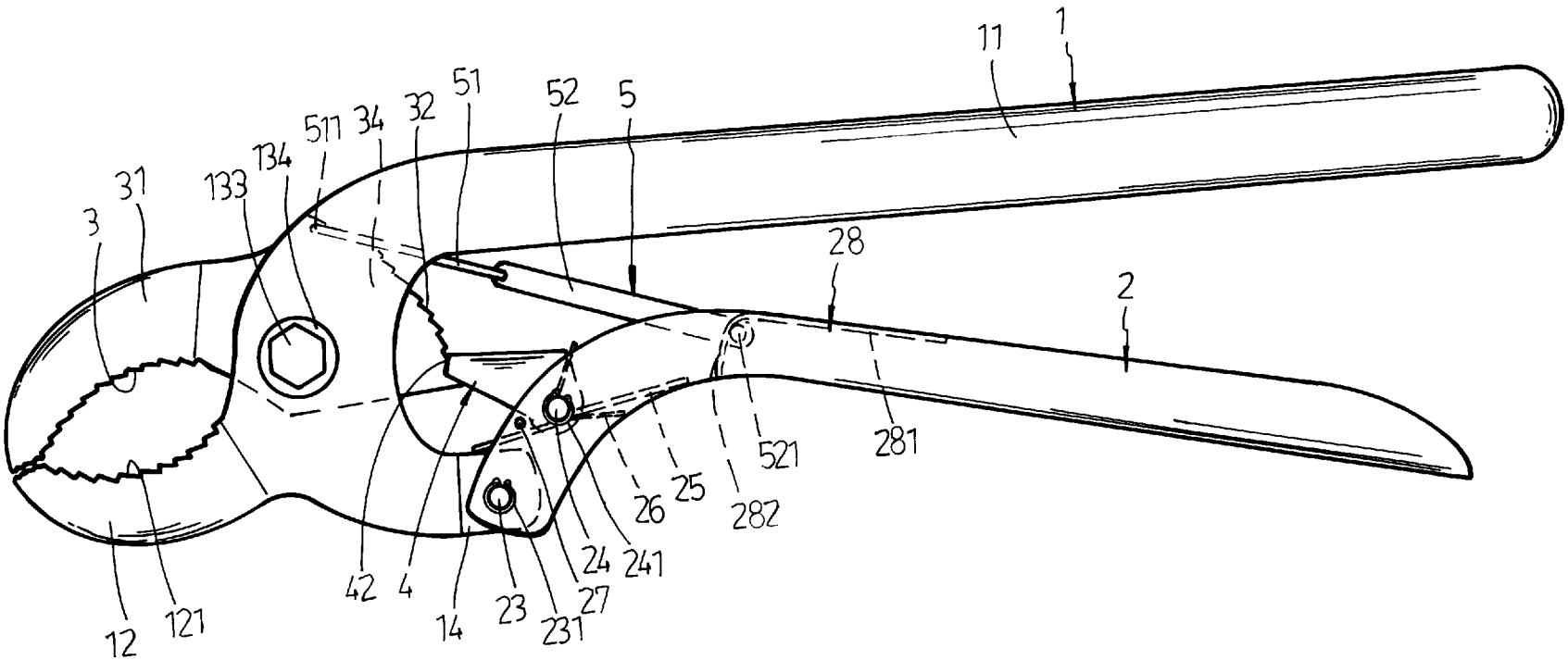
FIG. 3 is a plan schematic view of the pliers of the present invention in a closed state.

Referring to FIGS. 1, 2, and 3, the present invention comprises mainly a body 1, a movable handle 2, a movable jaw 3, a push block 4, and a pull element 5.

The body 1 includes a fixed handle 11, a fixed jaw 12, a pivot 13, and an extension 14. The movable handle 2 is provided with a first pair of through holes 21, a second pair of through holes 22, a first pin shaft 23, a second pin shaft 24, a first spring 25, a second spring 26, a positioning element 27, and a slide track 28. The movable jaw 3 includes curved jaw teeth 31, a curved rack portion 32, a pivot hole 33, inner recessed faces 34, and opposed through holes 35. The push block 4 is provided with opposed through holes 41, and a U-shaped end push portion 42. The pull element 5 includes a U-shaped portion 51 and a pull lever 52, such that they can perform a joint action at where they are connected.

The fixed jaw 12 of the body I is provided with curved jaw teeth 121. The pivot 13 is provided with a through opening 131 for receiving a lower portion of the movable jaw 3. The outer wall of the through hole 131 is provided with opposed through pivot holes 132. A bolt 133 is inserted into the opposed through pivot holes 132 of the pivot 13, and the pivot hole 33 of the movable jaw 3 to enable the jaw to turn about an angle using the bolt 133 as a pivot. Before the bolt is passed through the opposed through pivot holes 132, it is fitted with a packing 134 and a compression spring 136, with a packing 134 and a nut 135 locked at the other end, such that the compression spring 136 can press elastically against the peripheral portion of the pivot hole 33 of the movable jaw 3. In this way, when the movable jaw 3 turns about an angle, a certain tightness is maintained for movement purposes, and loosening and slippage can be avoided. In addition, the extension 14 is provided with an axial hole 141 for connecting axially to the movable handle 2.

The above-mentioned movable handle 2 has a body of a substantially U-shaped cross section. The first pin shaft 23 is passed through the first pair of through holes 21 at the upper end of the movable handle and the axial hole 141 of the extension. Annular grooves at both ends of the first pin shaft 23 receive C-shaped rings 231 respectively so that the movable handle 2 may perform angular displacement with the first pin shaft 23 as an axis. The second pin shaft 24 is passed through the second pair of through holes 22 of the movable handle 2 and the opposed through holes 41 of the push block 4 so that the push block can perform angular rotation using the second pin shaft 24 as a spindle. The second pin shaft 24 is provided with the above-mentioned first and second springs 25, 26, and has annular grooves at both ends for receiving C-shaped rings 241 respectively. One end of the first spring 25 presses the extension 14, with the other end pressing inner walls of the movable handle 2, so that it can keep the movable handle 2 extended outwardly at a certain angle distal to the fixed handle 11. In other words, when the movable handle 2 is pressed in the direction of the fixed handle 11, it can automatically reset to the extended position. One end of the second spring 26 presses the inner walls of the movable handle 2, with the other end pressing the bottom portion of the push block 4, causing the U-shaped end push portion 42 to orient towards the extension 14 of the body 1. In addition, since the push block contacts the positioning element 27 of the movable handle 2 and is thereby maintained in a set internally closed state, when the U-shaped end push portion 42 of the push block 4 presses upwardly against the curved rack portion 32 of the movable jaw 3, it can open outwardly and turn, as well as push the curved rack portion 32 (see FIG. 6). And when the movable handle 2 brings the push block 4 to disengage from the curved rack portion 32, the push block 4 can automatically reset to the set internally closed state to get ready for pressing the next acting tooth of the curved rack portion 32 (see FIGS. 7 and 8).

Figure 4:
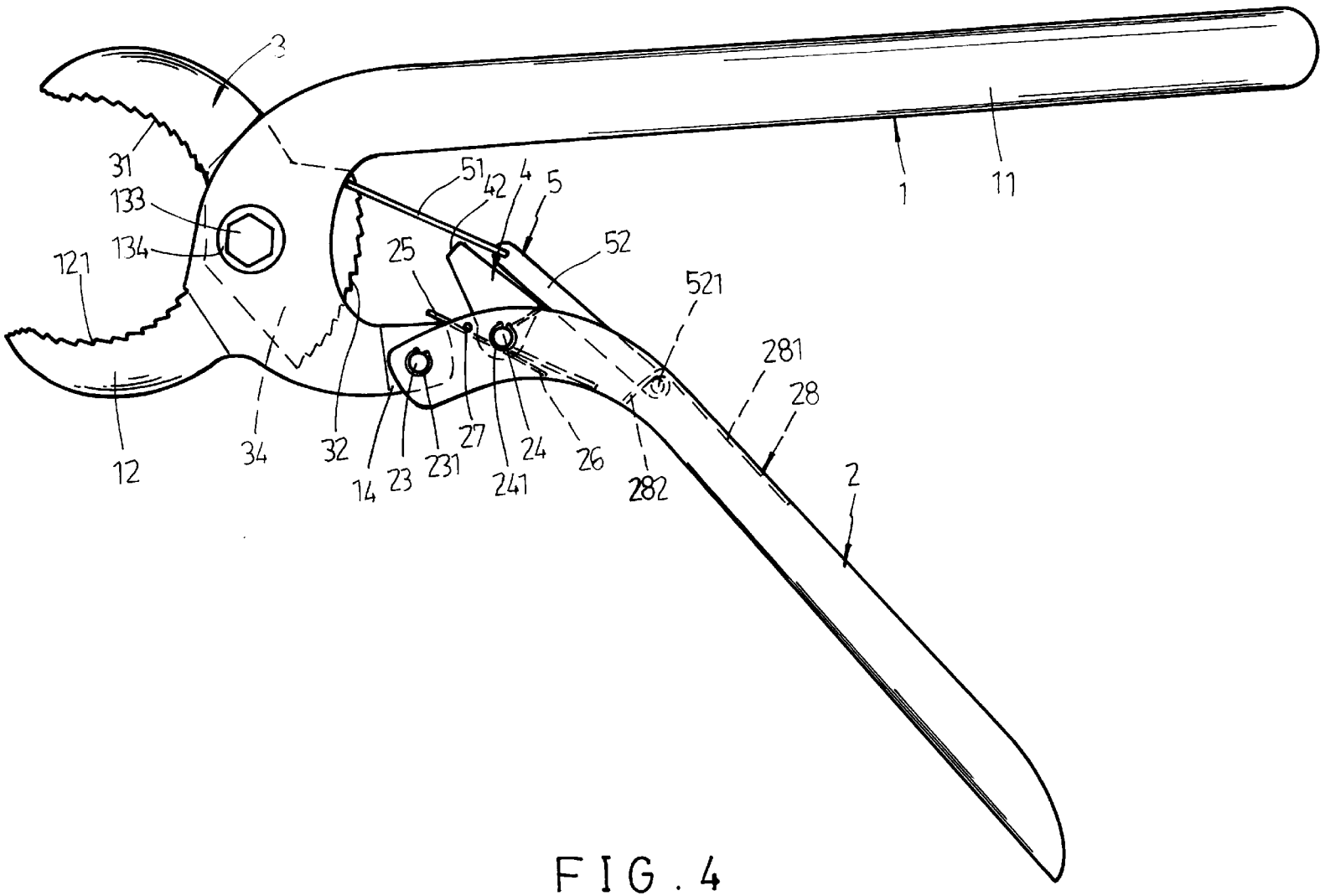
FIG. 4 is a plan schematic view of the pliers of the present invention in a completely open state.

Referring to FIGS. 1 to 4, both sides of the lower portion of the movable jaw 3 are provided with the above-mentioned inner recessed faces 34. This arrangement causes the formation of clearances between the inner recessed faces 34 and the two side walls of the through opening 131 for receiving the U-shaped portion 51 of the pull element 5, with pins 511 at upper ends of the U-shaped portion 51 inserted into the opposed through holes 35 of the movable jaw 3. And since the opposed through holes 35 are provided at the outer sides of the lower portion of the movable jaw 3 and are at a certain distance away from the bolt 133 and pivot hole 33, when the pull element 5 is pulled downwardly, the movable jaw 2 can be pulled to open outwardly using the bolt 133 as pivot. Furthermore, the slide track 28 of the movable handle 2 is provided with a longitudinal slit 281 and a stop portion 282. The lower end of the pull lever 52 is provided with projecting pivots 521 at a lower end thereof. Therefore, the pull lever 52 can be inserted into the longitudinal slit 281 and displaced therein, and the projecting pivots 521 can prevent the pull lever 52 from slipping out of the slide track 28. And when a force is exerted to pull the movable handle 2 away from the fixed handle 11, since the stop portion 282 retains the projecting pivots 521, the pull element 5 displaces in the direction of the movable handle 2. This means that the movable jaw 3 can be pulled to turn about and open to a desired angle by using the pins 511 at the upper end of the pull element 5. As shown in FIG. 4, the movable jaw 3 is pulled to a completely open position.

Figure 5:
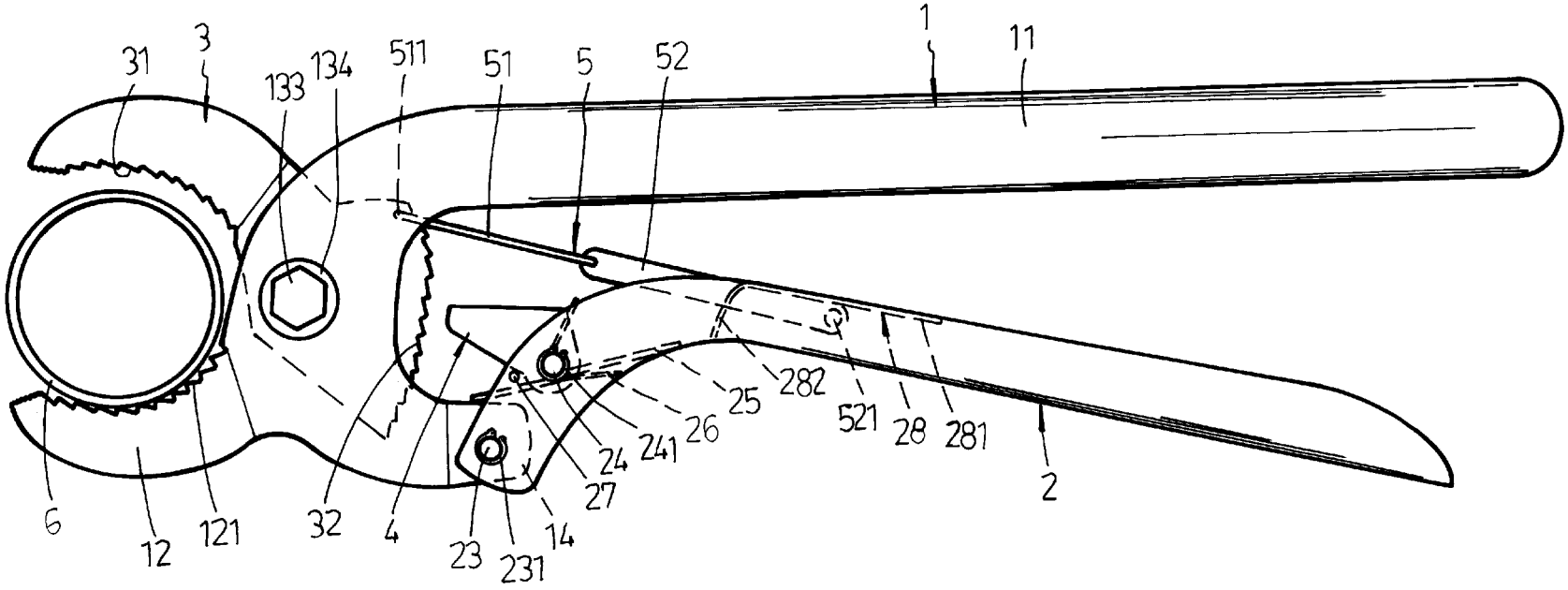
FIG. 5 is a plan view illustrating the first action in operating the pliers of the present invention on a pipe.
Figure 6:
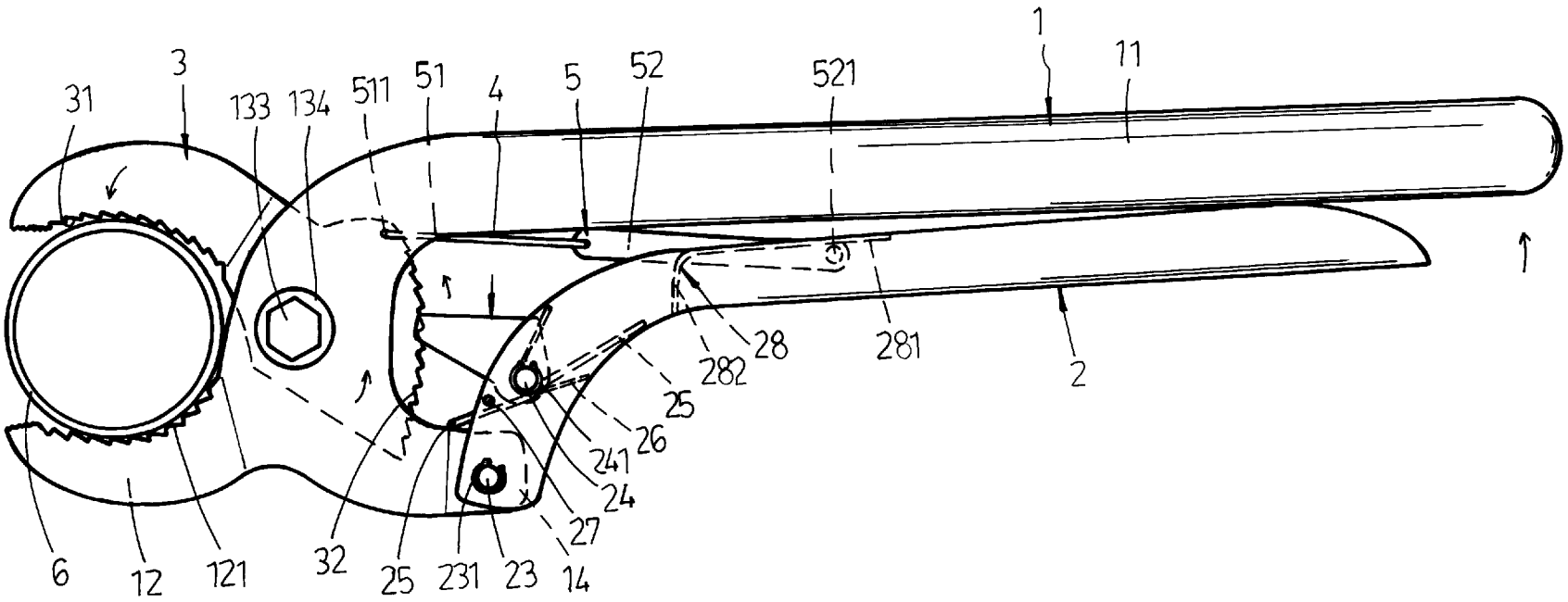
FIG. 6 is a plan view illustrating the second action in operating the pliers of the present invention on the pipe.
Figure 7:
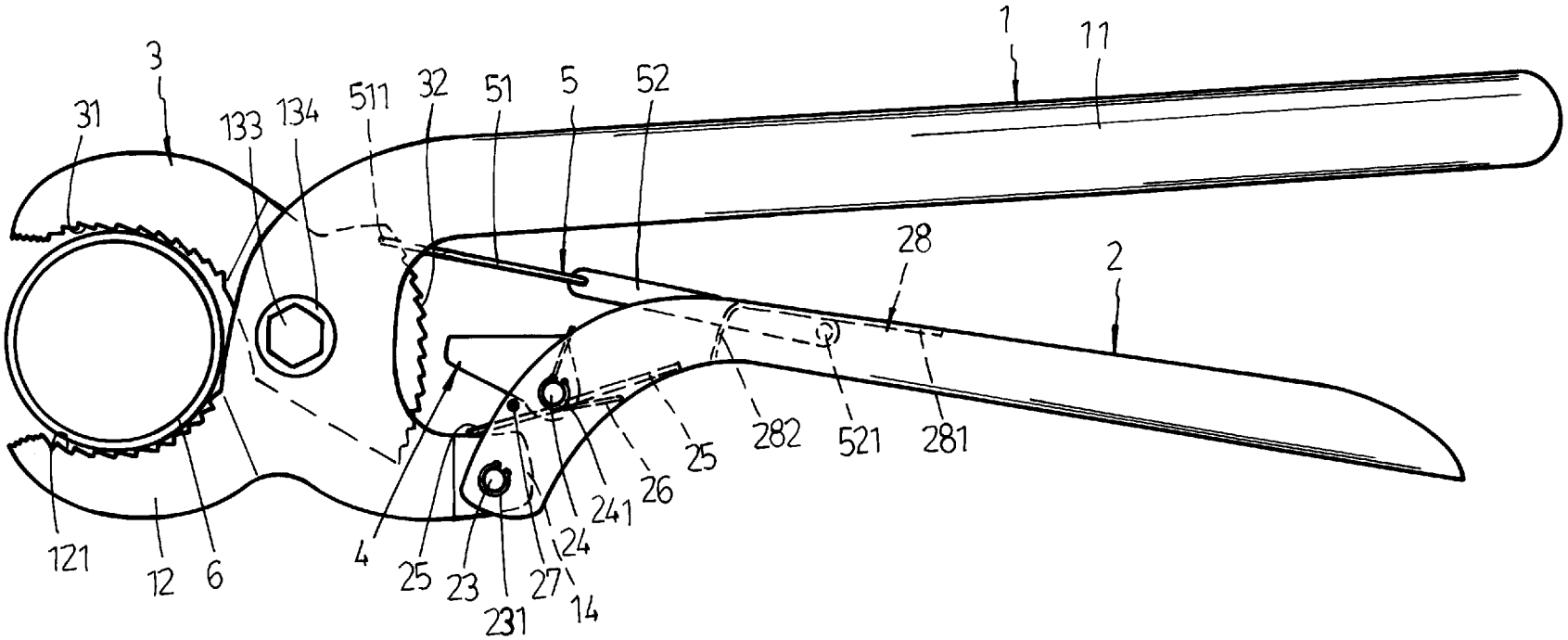
FIG. 7 is a plan view illustrating the third action in operating the pliers of the present invention on the pipe.
Figure 8:
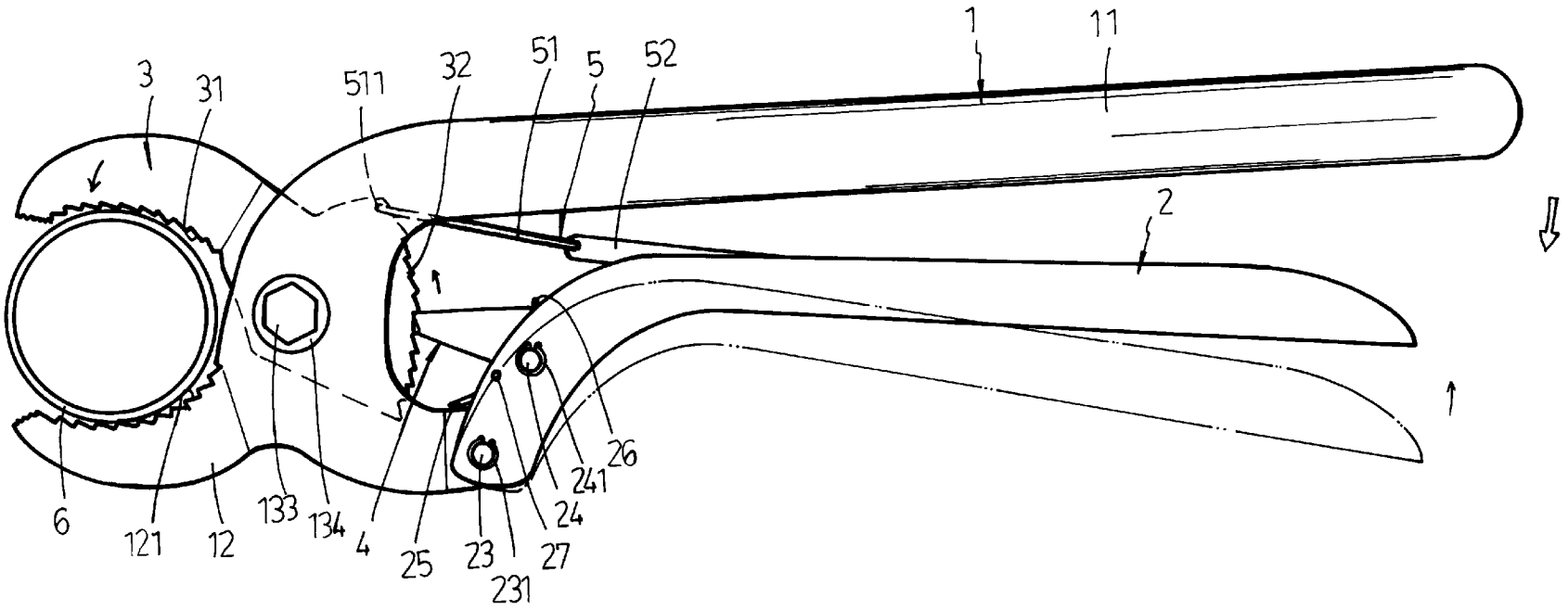
FIG. 8 is a plan view illustrating the fourth action in operating the pliers of the present invention on the pipe.

Reference is made to FIGS. 5 and 8. In use, referring to FIG. 5 first, after judging the external diameter of a pipe 6 using the naked eyes, a force is applied on the movable handle 2 to cause the movable jaw 3 to open to an angle slightly larger than the external diameter of the pipe 6. Then, as shown in FIG. 6, the movable handle 2 is held inwardly so that it displaces in the direction of the fixed handle 11. At this time, the U-shaped end push portion 52 of the push block 4 will engage the front acting teeth of the curved rack portion 32 of he movable jaw 3 so that the U-shaped end push portion 42 presses upwardly and pushes the curved rack portion 32 of the movable jaw 3 in the direction opposite to the extension 14, causing the movable jaw 3 to displace a determined distance, i.e., the movable jaw 3 displaces about a small angle in the direction of the pipe 6 to close thereupon. Next, as shown in FIG. 7, when the movable handle 2 is released, it will, due to the action of the first spring 25, automatically reset to the set open angle. And the push block 4 is also subjected to the action of the second spring 26 and the positioning element 27 and caused to reset to the set closed position to get ready to press the next acting tooth of the curved rack portion 32. Referring to FIG. 8, after performing the operational steps as shown in FIGS. 6 and 7, the fixed jaw 12 and the movable jaw 3 are in contact with the outer rim of the pipe 6. The movable handle 2 is then pressed so that it displaces towards the fixed handle 11, causing the unshaped end push portion 42 of the push block 4 to press upwardly against the curved rack portion 32 of the movable jaw 3, so that the curved jaw teeth 31 of the movable jaw 3 exert a clamping force against the pipe 3, and by applying a force on the fixed handle 11, the pipe 6 can by turned.

Figure 9:
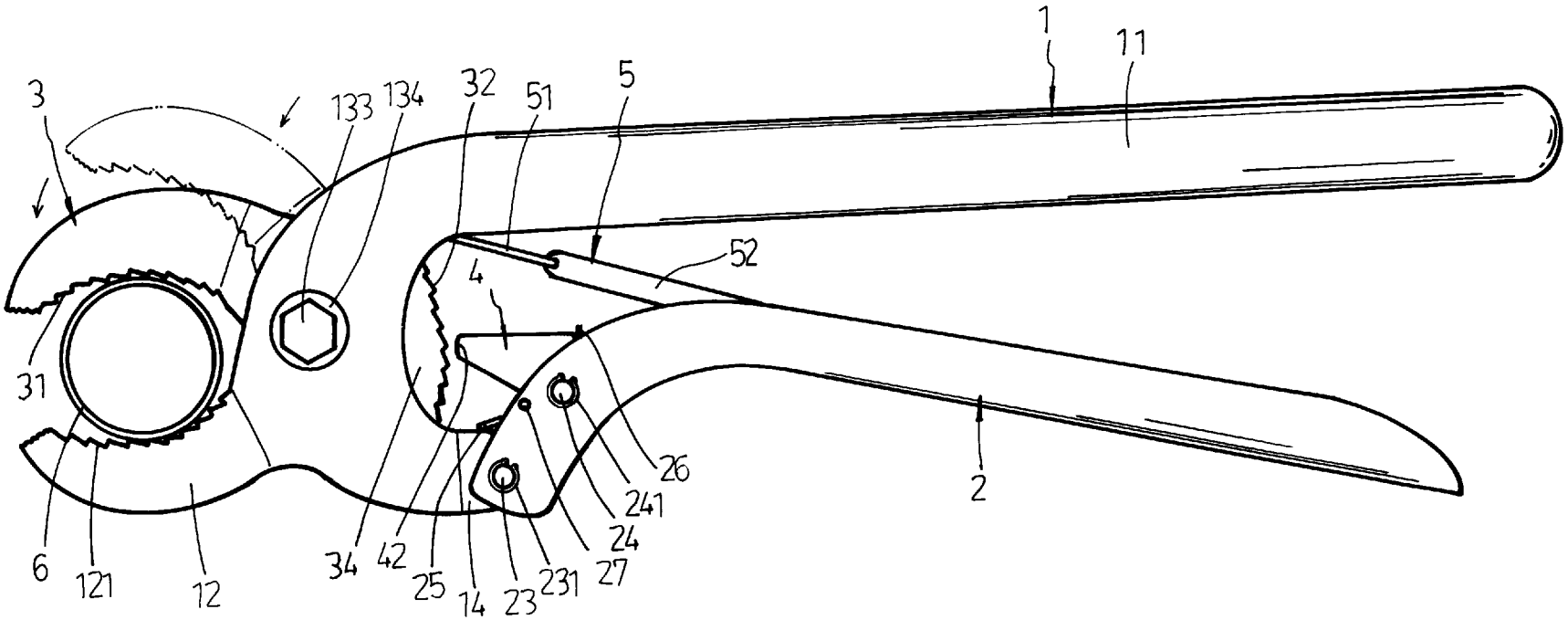
FIG. 9 is a plan view illustrating the first action in operating the pliers of the present invention on a small-diameter pipe.
Figure 10:
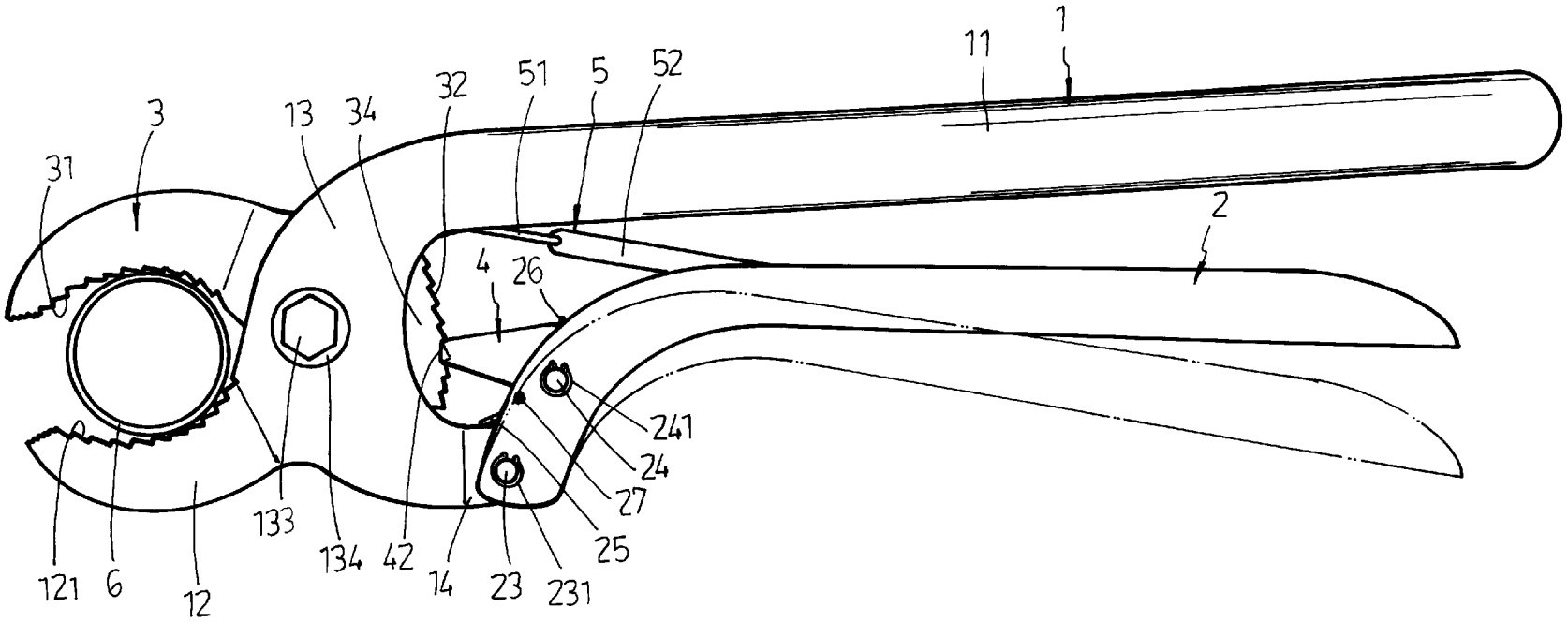
FIG. 10 is a plan view illustrating the second action in operating the pliers of the present invention on the small-diameter pipe.

Referring to FIGS. 9 and 10, when working on a pipe 6 of a smaller diameter and the movable jaw 3 is located at a larger open angle position, the movable jaw 3 can be pressed in the direction of the fixed jaw 12 so that it contacts the outer rim of the pipe 6. As shown in FIG. 10, by holding the movable handle 2 and the fixed handle 11 tightly, the push block 4 will press upwardly against the curved rack portion 32 of the movable jaw 3 to clamp the pipe 6. And by exerting a force on the fixed handle 11, the pipe 6 can be turned.

In the present invention, the large-angle opening or closing of the movable jaw 3 can be achieved in a single operational step. It does not require much time to adjust the opening or closing angle of the movable jaw 3 to work on pipes 6 of different diameters. Besides, the movable jaw 3 can be caused to clamp the pipe 6 by exerting a pressure on the movable handle 2. Furthermore, as the movable jaw 3 is set to displace about a small angle, and the curved jaw teeth 31, 121 are configured to contact the pipe 6 with their curved faces, an enhanced clamping effect can be achieved.

Although the present invention has been illustrated and described with reference to the preferred embodiment thereof, it should be understood that it is in no way limited to the details of such embodiment but is capable of numerous modifications within the scope of the appended claims.

What is claimed is:

1. A pair of pliers for gripping an outer surface of a pipe and comprising:

a) a body including a fixed handle portion, a fixed jaw portion having a first concavely curved surface with first jaw teeth thereon, an extension portion and a pivot portion located between the fixed handle portion and the fixed jaw portion;

b) a movable jaw pivotally attached to the pivot portion of the body so as to pivot about a pivot bolt extending through the pivot portion and the movable jaw, the movable jaw having a second concavely curved surface with second jaw teeth thereon facing toward the first jaw teeth, and a convexly curved rack portion having teeth thereon;

c) a movable handle pivotally connected to the extension of the body so as to pivot relative to the body about a pivot axis, the movable handle having a stop portion;

d) a pull element having a first end connected to the movable jaw at a location spaced from the pivot bolt and a second end engaging the movable handle;

e) a push block mounted on the movable handle at a location spaced from the pivot axis, the push block having an end push portion configured and located so as to engage the curved rack portion of the movable jaw when the movable handle is moved toward the fixed handle thereby moving the second jaw teeth of the movable jaw toward first jaw teeth of the fixed jaw; and, f) a movable handle biasing spring acting on the movable handle to bias the movable handle away from the fixed handle such that the stop portion of the movable handle engages the second end of the pull element to thereby move the movable jaw away from the fixed jaw.

2. The pair of pliers of claim 1 wherein the movable handle biasing spring contacts the movable handle and the extension of the body.

3. The pair of pliers of claim 1 further comprising:

a) a through hole extending through the pivot portion of the body; and b) recessed faces formed on the movable jaw, the recessed face extending through the through hole.

4. The pair of pliers of claim 1 further comprising a longitudinal slit formed in the movable handle in which the second end of the pulling element is slidably retained.

5. The pair of pliers of claim 1 further comprising:

a) a positioning element mounted on the movable handle; and, b) a push block spring acting on the push block to bias the push block into contact with the positioning element.

6. The pair of pliers of claim 5 wherein the push block spring acts on the push block and the movable handle.

7. The pair of pliers of claim 5 wherein the push block spring comprises a torsion spring.

8. The pair of pliers of claim 1 wherein the movable handle biasing spring comprises a torsion spring.

* * * * *